US007111919B2

(12) United States Patent
Hatasa et al.

(10) Patent No.: US 7,111,919 B2
(45) Date of Patent: Sep. 26, 2006

(54) RECORDING LIQUID CONTAINER AND INK JET RECORDING APPARATUS

(75) Inventors: Nobuyuki Hatasa, Kanagawa-ken (JP); Hajime Yamamoto, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 11/101,507

(22) Filed: Apr. 8, 2005

(65) Prior Publication Data

US 2005/0179756 A1 Aug. 18, 2005

Related U.S. Application Data

(62) Division of application No. 10/407,439, filed on Apr. 7, 2003, now Pat. No. 6,935,716.

(30) Foreign Application Priority Data

Apr. 10, 2002 (JP) ..... 2002-107718

(51) Int. Cl.
*B41J 29/393* (2006.01)
*B41J 2/175* (2006.01)

(52) U.S. Cl. ..... 347/19; 347/86

(58) Field of Classification Search ..... 347/5, 347/14, 19, 85, 86, 87
See application file for complete search history.

(56) References Cited

U.S. PATENT DOCUMENTS

| | | | | |
|---|---|---|---|---|
| 6,442,403 | B1 | 8/2002 | Becot | 455/575.1 |
| 6,502,917 | B1 | 1/2003 | Shinada et al. | 347/19 |
| 6,585,345 | B1 | 7/2003 | Kosugi | 347/19 |
| 6,935,716 | B1 * | 8/2005 | Hatasa et al. | 347/19 |
| 2002/0015066 | A1 | 2/2002 | Siwinski et al. | 347/19 |
| 2002/0030714 | A1 | 3/2002 | Walker | 347/19 |
| 2002/0109761 | A1 | 8/2002 | Shimizu et al. | 347/19 |
| 2002/0135630 | A1 | 9/2002 | Kosugi | 347/19 |
| 2003/0214546 | A1 | 11/2003 | Hatasa et al. | 347/19 |
| 2003/0215280 | A1 | 11/2003 | Hatasa et al. | 347/19 |

FOREIGN PATENT DOCUMENTS

| | | |
|---|---|---|
| DE | 199 17 229 | 10/2000 |
| DE | 199 54 749 | 5/2001 |
| EP | 1060895 | * 12/2000 |
| EP | 1114726 | 7/2001 |
| JP | 2000-37880 | 2/2000 |
| JP | 2001-30516 | 2/2001 |

* cited by examiner

*Primary Examiner*—Anh T. N. Vo
(74) *Attorney, Agent, or Firm*—Fitzpatrick, Cella, Harper & Scinto

(57) ABSTRACT

A recording liquid container for containing liquid for recording to be supplied to recording means, said recording liquid container being detachably mountable to a mounting portion of a recording device, said recording liquid container includes an information memory medium storing predetermined information; and wireless sending means which is capable of sending the predetermined information stored in said information memory medium within a predetermined limited range.

3 Claims, 7 Drawing Sheets

RECORDING LIQUID CONTAINER AND INK JET RECORDING APPARATUS

FIELD OF THE INVENTION AND RELATED ART

The present invention relates to a recording liquid container for storing the recording liquid to be supplied to a recording head. It also relates to an ink jet recording apparatus in which a recording liquid container in the form of a cartridge is removably mountable.

There are various apparatuses, a single or plurality of parts of which are in the form of a cartridge which can be removably mountable in the main assembly of the apparatus. For example, an ink jet printer is structured so that a single or plurality of ink cartridges are removably mountable in its main assembly.

Referring to FIG. 9, an example of a conventional ink jet printer structured as described above will be described. Hereafter, the upward, downward, forward, and rearward directions mean the directions indicated by the arrow marks in FIG. 9. This ink jet printer 1 comprises the main assembly (unshown) and an ink cartridge 2. The ink cartridge 2 is removably mountable in the main assembly of the printer 2.

The ink cartridge 2 has a box-shaped main structure 4. This main structure 4 contains ink (unshown). The main structure 4 also has an ink outlet 5, which is attached to the front portion of the bottom wall, that is, the wall which will be at the bottom after the proper mounting of the ink cartridge 2 in the main assembly of the printer 2. The main structure 4 of the cartridge 2 also has a projection 7 and a lever 8 for locking the ink cartridge 2 in the predetermined position in the main assembly of the printer 2. The projection 7 protrudes from the bottom front edge of the cartridge main structure 4, and the locking lever 8 protrudes diagonally upward from the bottom rear edge of the cartridge main structure 4. The locking lever 8 can be elastically bent toward, or away from, the cartridge main structure 4, and has a locking claw 9, which protrudes from a predetermined location on the rear surface of the locking lever 8.

The printer main assembly is provided with a carriage 11, as a cartridge holder, which has a recess 12 in which the ink cartridge 2 is removably mountable. The recess 12 has a projection 13 and a projection 14. The projection 13 protrudes from the bottom portion of the front surface of the recess 12, and the projection 14 projects from a predetermined location on the rear surface of the recess 12. With the front projection 13 of the carriage 11, the projection 7 of the ink cartridge 2 engages, whereas with the rear projection 14, the locking claw 9 of the ink cartridge 2 engages.

The carriage 11 has an ink inlet 15, which is attached to the front portion of the bottom wall of the recess 12 of the carriage 11. The ink inlet 15 and the ink outlet 5 of the ink cartridge 2 can be connected or disconnected.

With the provision of the above described structural arrangement, as the ink cartridge 2 is mounted onto the carriage 11 of the printer main assembly, ink is supplied from the ink cartridge 2 to the main assembly of the ink jet printer 1. The ink cartridge 2 is mounted onto the carriage 11 in the following manner: first, the ink cartridge 2 is to be held tilted so that its rear side becomes higher than the front side, as shown in FIG. 9(*a*). Then, the ink cartridge 2 is to be lowered into the recess 12 of the carriage 11 so that the projection 7 of the ink cartridge 2 engages with the projection 13 of the carriage 11 diagonally, from behind, as shown in FIG. 9(*b*).

Next, the rear side of the ink cartridge 2 is to be pushed down, while elastically bending the locking lever 8, which is in contact with the projection 14 of the carriage, as shown in FIG. 9(*c*), until the locking claw 9 of the locking lever 8 locks with the projection 14 of the carriage 11, as shown in FIG. 9(*d*).

The moment the locking claw 9 of the ink cartridge 2 locks with the projection 14 of the carriage 11, the person who is mounting the ink cartridge 2 can feel and hear a "click", which assures that the ink cartridge 2 has just been properly mounted on the carriage 11.

The ink cartridge 2 properly mounted on the carriage 11 can be removed from the carriage 11 by pushing the top end portion of the locking lever 8 frontward with a finger (unshown) so that the locking claw 9 becomes disengaged from the projection 14.

The above described structural arrangement for the ink jet printer 1 is very simple, and yet, makes it easy to removably mount the ink cartridge 2 onto the carriage 11. Further, when the locking claw 9 properly engages with the projection 14, it generates the "clicking" sound while providing a user with the feel of "click", informing the user that the ink cartridge 2 has just been properly mounted.

However, these feel of the "click" and sound of the "click" are very subtle. Therefore, when, for example, a user who is not familiar with these "clicking" phenomena mounts the ink container 2, the user sometimes fails to push down the ink container all the way into the recess of the carriage 11, causing the ink cartridge 2 to end up in the state shown in FIG. 9(*c*).

When the ink cartridge 2 is in the above described state shown in FIG. 9(*c*), the ink outlet 5 of the ink cartridge 2 and the ink inlet 15 of the carriage 2 are improperly connected, which sometimes may prevent ink from being supplied to the printer main assembly. At a glance, however, the ink cartridge 2 appears to be properly mounted on the carriage 11. Therefore, it is difficult for the user unfamiliar with the above described structural arrangement to recognize that the ink cartridge 2 has not been properly mounted on the carriage 11.

If the ink jet printer 1, in which the ink container is in the above described condition, is made to carry out a printing operation, printing paper is wastefully consumed. In addition, air is sucked, along with ink, into the ink jet head, making it necessary to carry out an operation for removing the air from the ink jet head. In some cases, it is too difficult to remove such air from the ink jet, making it necessary to replace the ink jet head itself.

In order to solve the above described problem, it is possible to attach a single or plurality of electrical terminals on the rear portion of the bottom surface of the bottom wall of the ink cartridge 2 and the rear portion of the top surface of the bottom wall of the recess 12 of the carriage 11, so that it becomes possible for the printer main assembly to electrically confirm whether or not the electrical terminal on the ink cartridge side is in contact with the electrical terminal on the carriage side (unshown).

Japanese Laid-open Patent Application 2000-037880, for example, discloses a printing apparatus (unshown), which employs an ink cartridge having an information storage medium, making it possible for information to be supplied from the ink cartridge to the printer main assembly. The ink cartridge 2 and carriage 11, however, are sometimes contaminated by ink. Therefore, the electrical terminals such as the above described ones are highly likely to be poorly connected, making it difficult to always accurately determine whether or not the ink cartridge 2 has been properly mounted on the carriage 11.

Further, if the electrical terminals such as those described above become shorted, it is possible that the information storage medium is subjected to a large amount of electrical load, resulting in the erasure of the information stored therein, or the destruction thereof.

The same patent application also discloses the wireless transmission of information from an ink cartridge to the printer main assembly, with the use of radio waves. This arrangement, however, has not taken into consideration the relationship between the mounting of an ink container onto the printer main assembly and the wireless communication. Therefore, it is possible that even if an ink cartridge has been improperly mounted in the printer main assembly, the wireless communication between the printer main assembly and ink cartridge may be satisfactory, making it difficult to accurately judge whether or not the ink cartridge has been properly mounted in the printer main assembly.

SUMMARY OF THE INVENTION

The present invention was made in consideration of the above described problem. Thus, its primary object is to provide a combination of an apparatus which employs a cartridge, and a cartridge therefor, which makes it possible to accurately determine whether or not the cartridge has been properly mounted into the main assembly of the apparatus.

According to an aspect of the present invention, there is provided a recording liquid container for containing liquid for recording to be supplied to recording means, said recording liquid container being detachably mountable to a mounting portion of a recording device, said recording liquid container comprising an information memory medium storing predetermined information; and wireless sending means which is capable of sending the predetermined information stored in said information memory medium within a predetermined limited range.

According to another aspect of the present invention, there is provided a container wherein said mounting portion is capable of mounting a plurality of such recording liquid containers mounted adjacent to each other, and wherein the predetermined limited range is such that wireless sending means is incapable of sending the predetermined information to the adjacent one.

According to a further aspect of the present invention, there is provided a container wherein said mounting portion is provided with receiving means for wirelessly receiving the predetermined information from said wireless sending means when said recording liquid container is substantially completely mounted to the mounting portion.

According to a further aspect of the present invention, there is provided a container wherein said recording device includes electric power supplying means for supplying electric power through electromagnetic induction, and said recording liquid container has electric power generating means for generating electric power by said electromagnetic induction and supplying the electric power to said wireless sending means.

According to a further aspect of the present invention, there is provided a container wherein said information memory medium renewably stores the predetermined information and has information accommodating means, and wherein said wireless communicating means wirelessly receives radio wave and converts the radio wave to information, which is accommodated in said information accommodating means.

According to a further aspect of the present invention, there is provided an ink jet recording apparatus having an ink cartridge mounting portion for mounting an ink cartridge for containing ink to be supplied to an ink jet head, said ink cartridge is detachably mountable to said ink jet head, wherein said ink cartridge includes an information memory medium storing predetermined information, and wireless sending means which is capable of sending the predetermined information stored in said information memory medium within a predetermined limited range; wherein said mounting portion of said recording device is provided with wireless communicating means for wirelessly receiving the information sent from said wireless sending means of said ink cartridge; and wherein said wireless communicating means is disposed in said predetermined limited range when said ink cartridge is mounted properly to said mounting portion.

According to a further aspect of the present invention, there is provided an apparatus further comprising electric power supplying means for supplying electric power to said ink cartridge through electromagnetic induction, and said ink cartridge includes electric power generating means for generating electric power through the electromagnetic induction and supplying the electric power to said wireless sending means.

According to a further aspect of the present invention, there is provided an apparatus further comprising electric power control means for permitting supply of the electric power to said electric power supplying means at predetermined timing, and error discriminating means for discriminating mounting error upon failure of wireless reception of t information by said wireless communicating means when the electric power is supplied thereto.

According to a further aspect of the present invention, there is provided an apparatus wherein said wireless communicating means is positioned outside the predetermined limited range before said ink cartridge is mounted to said mounting portion, and is positioned inside the predetermined limited range after said ink cartridge is mounted to said mounting portion.

According to a further aspect of the present invention, there is provided an apparatus wherein said mounting portion is capable of mounting a plurality of such ink cartridges, and there are provided a plurality of such wireless communicating means which are capable of communication with respective ink cartridges.

According to a further aspect of the present invention, there is provided a cartridge mounting device for detachably moounting a cartridge, wherein an apparatus in accordance with the present invention, which comprises the main assembly and a single or plurality of cartridges, is such an apparatus that comprises: the main assembly in which a single or plurality of cartridges are removably mountable; and a single or plurality of cartridges which are removably mountable in the main assembly. Each cartridge comprises: an information storage means which stores information of a predetermined type; and a wireless transmitting means capable of at least wirelessly transmitting information a specified distance. The apparatus main assembly comprises: a cartridge holding means in which a single or plurality of the cartridges are removably mountable; a wireless communicating means capable of wirelessly receiving information from the cartridge; and a wireless communicating means holding means capable of assuring that the wireless communicating means will be within the wireless communication range of the wireless transmitting means of the cartridge only after the proper mounting of the cartridge in the cartridge holding means.

The printing apparatus in accordance with the present invention, which comprises the main assembly and a single or plurality of ink cartridges, is such a printing apparatus that comprises: the main assembly in which a single or plurality of ink cartridges are removably mountable; and a single or plurality of ink cartridges which are removably mountable in the main assembly. Each ink cartridge comprises: the main structure which stores ink; an ink supplying means for supplying the ink stored in the main structure to the printer main assembly; an information storage means which stores information of a predetermined type; and a wireless transmitting means capable of at least wirelessly transmitting information a specified distance. The printer main assembly comprises: an ink cartridge holding means in which a single or plurality of the ink cartridges are removably mountable; an ink receiving means to be connected to the ink supplying means of an ink cartridge on the cartridge holding means in order to receive ink; a wireless communicating means capable of wirelessly receiving information from the ink cartridge; and a wireless communicating means holding means capable of assuring that the wireless communicating means will be within the wireless communication range of the wireless transmitting means of the ink cartridge only after the proper mounting of the ink cartridge in the ink cartridge holding means.

In the case of a printing apparatus in accordance with the present invention, as an ink cartridge is mounted in the cartridge holding means of the printer main assembly, the ink supplying means of the ink cartridge becomes connected to the ink receiving means of the printer main assembly, allowing ink to be supplied from the ink cartridge to the printer main assembly.

In addition, the information stored in the information storage means of each ink cartridge is wirelessly transmitted to the wireless communicating means of the printer main assembly by the wireless transmitting means of the ink cartridge. The wireless transmitting means of the ink cartridge, however, wirelessly transmits the information only a specified distance. Further, the communicating means holding means of the printer main assembly holds the wireless communicating means of the apparatus main assembly in such a manner that the wireless communicating means will be within the range of the wireless transmitting means of the ink cartridge only after the proper mounting of the ink cartridge in the cartridge holding means. Therefore, the information from the ink cartridge is wirelessly received by the wireless communicating means of the printer main assembly only after the proper mounting of the ink cartridge in the cartridge holding means.

Further, it is possible to provide each ink cartridge with a power generating means in which the electric power to be supplied to the wireless transmitting means of the ink cartridge is electromagnetically induced, and to provide the printer main assembly with a power supplying means for electromagnetically inducing electric power in the electric power generating means of the ink container. In such a case, the printer main assembly supplies its power supplying means with electric power, with a predetermined timing, through the power controlling means, and if the wireless communication is not established between the wireless communicating means of the printer main assembly and wireless transmitting means of the ink cartridge while the power is supplied, it is determined by an error detecting means that the ink cartridge has not been properly mounted.

The information in the form of radio waves, which are received by the wireless communicating means of an ink cartridge may be converted into electrical signals and stored in the information storage means of the ink cartridge. Further, it is possible to design the wireless communicating means holding means of the printer main assembly so that before the connection of the ink supplying means and ink receiving means, the wireless communicating means will remain outside the range of the wireless transmitting means, and only after the completion of the proper connection of the ink supplying means and ink receiving means, the wireless communicating means will be within the range of the wireless transmitting means.

Further, it is possible to design the printer main assembly so that a plurality of ink cartridges can be mounted in the cartridge holding means, and also so that the printer main assembly is provided with a plurality of wireless communicating means for wirelessly communicating one for one with the plurality of ink cartridges in the cartridge holding means.

Regarding the various means mentioned in the above description of the present invention, all that is required of them is to be able to function as described above. Thus, they may be in the form of, for example, a dedicated hardware capable of performing predetermined functions, a computer programmed to perform predetermined functions, predetermined functions realized in a computer with the use of programs, or the combinations thereof, etc.

Further, it is not mandatory that they are independent from each other. For example, two or more of the above described various means may be integrated into a single component. One means may be formed as a part of another means. A part of one means may constitutes a part of another means. In other words, they may be configured in an optimum fashion.

These and other objects, features, and advantages of the present invention will become more apparent upon consideration of the following description of the preferred embodiments of the present invention, taken in conjunction with the accompanying drawings.

DESCRIPTION OF THE PREFERRED EMBODIMENTS

[Embodiment 1]

First, referring to FIGS. 1–7, the first embodiment of the present invention will be described. Hereafter, the preferred embodiments of the present invention will be described with reference to the directions with respect to the ink cartridge 2, that is, the front, rear, right, and left directions of the ink cartridge 2. The usage of the ink container 2 as the directional reference is for the simplification of the description, and has nothing to do with the positioning of the ink cartridge 2 during the production, usage, etc., of the apparatuses in accordance with the present invention.

Figure 1:
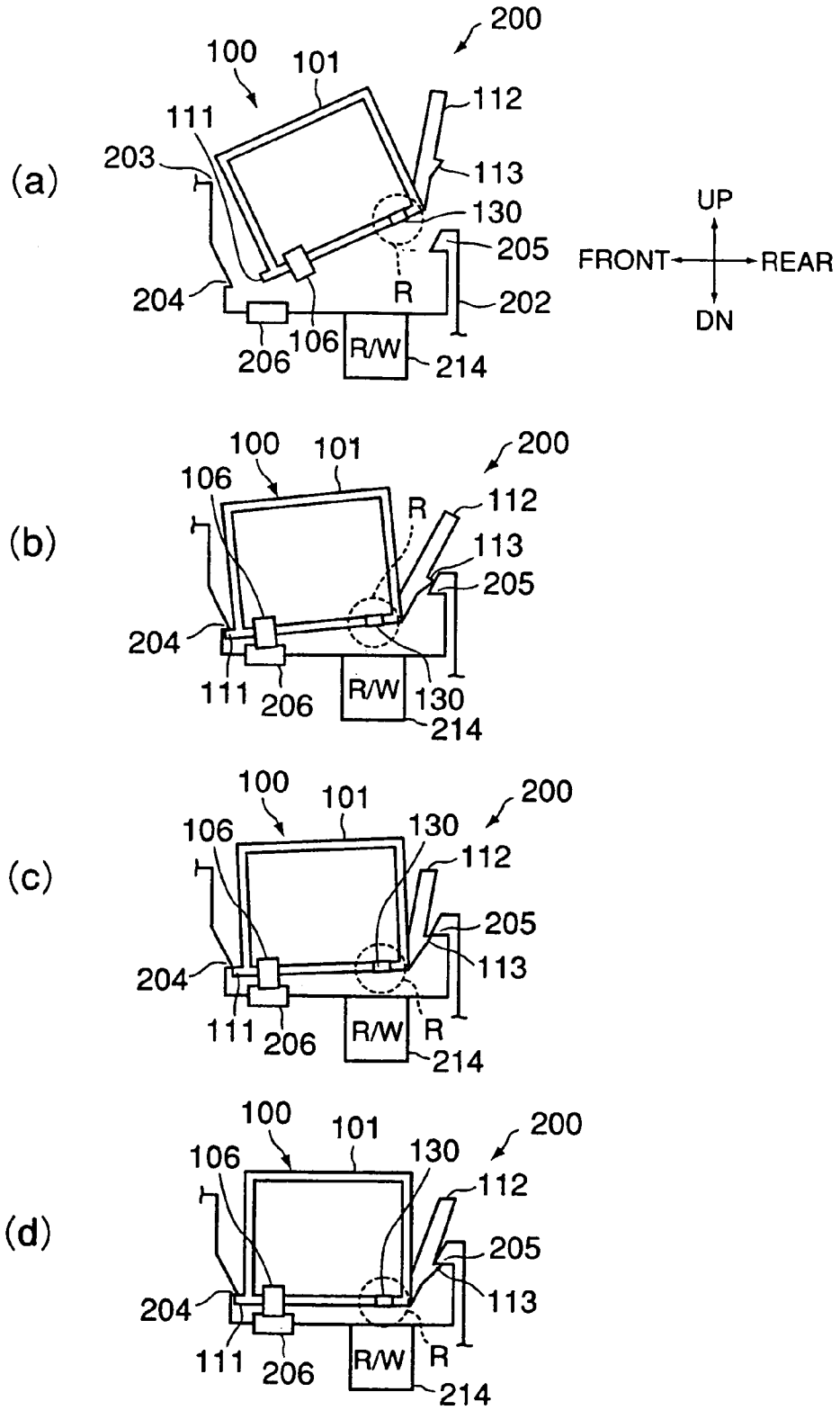
FIG. 1 is a schematic vertical sectional view of the first embodiment of a cartridge mounting apparatus in accordance with the present invention, showing the steps followed when an ink container in the form of a cartridge is mounted into the main assembly of a printer.
Figure 2:
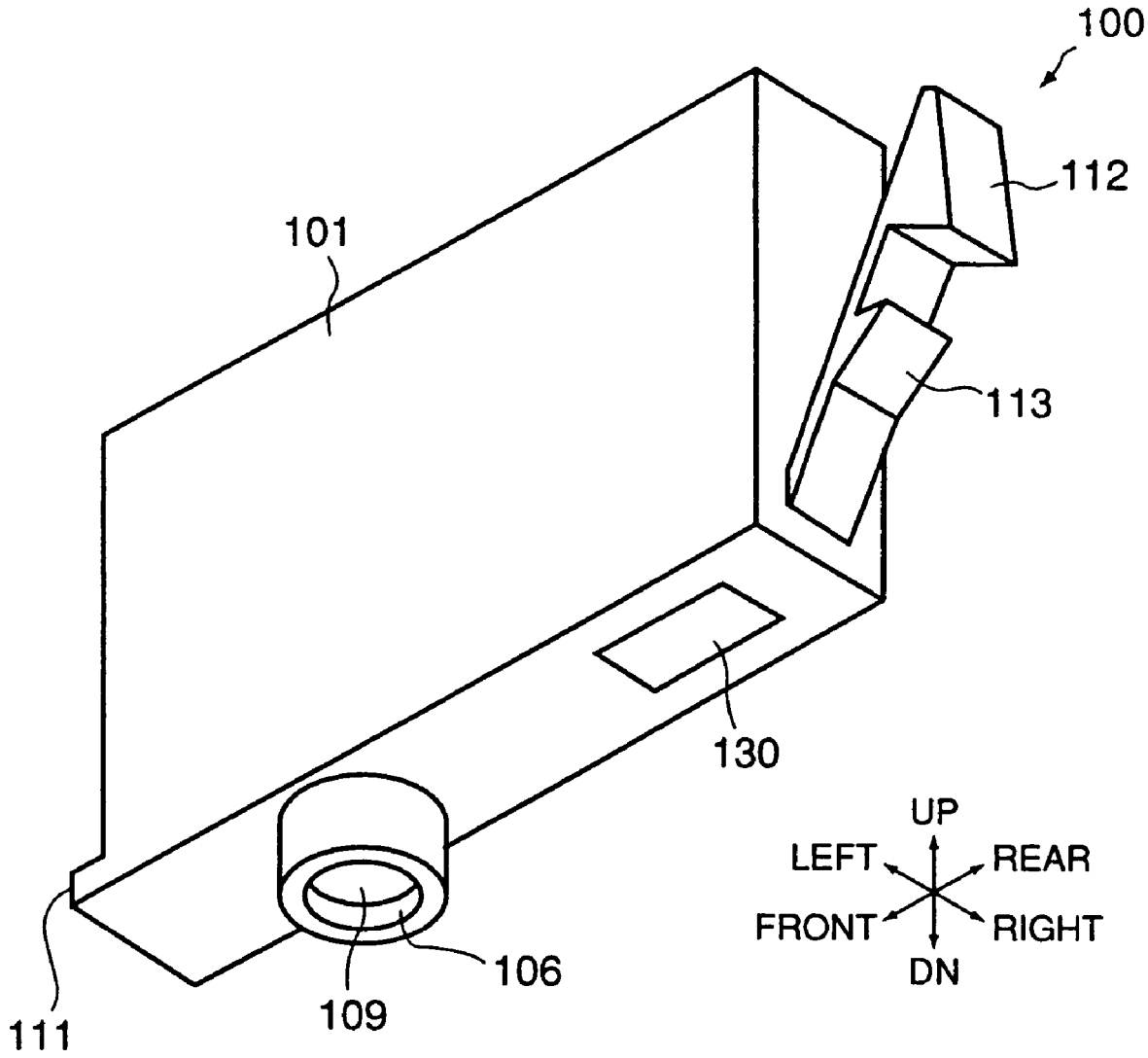
FIG. 2 is an external perspective view of an ink cartridge.

Referring to FIGS. 1 and 2, this embodiment of a cartridge 100 in accordance with the present invention is an ink cartridge, and is removably mountable in the main assembly 201 of a printing apparatus 200 as an example of an apparatus which employs a cartridge system.

Figure 3:
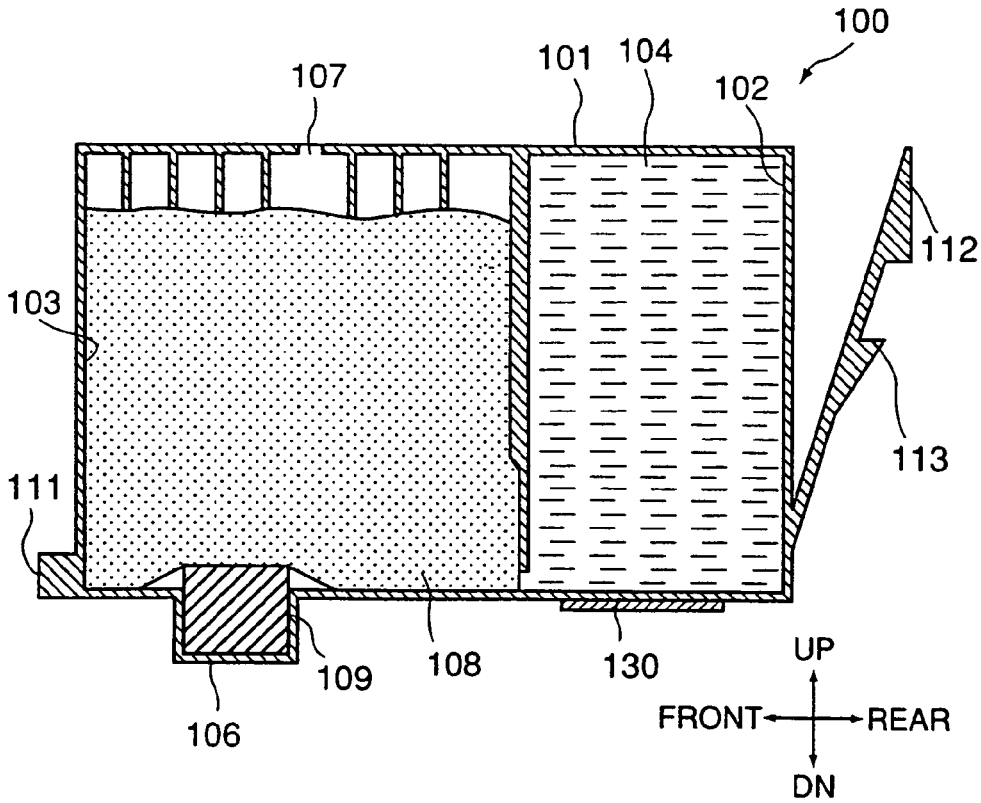
FIG. 3 is a vertical sectional view of the ink cartridge, showing the internal structure thereof.

Referring to FIGS. 1 and 2, the main assembly 101 of this ink cartridge 100 is in the form of a flat box, and is molded of a resinous substance. Referring to FIG. 3, the internal space of the main assembly 101 comprises an ink storage chamber 102, and a negative pressure generation chamber 103, which are separated by a partition. The ink storage chamber 102 is in connection with the negative pressure generation chamber 103, at their bottom ends, and contains ink 104 in the liquid form.

The negative pressure generation chamber 103 has an ink outlet 106 and an air vent 107. The ink outlet 103 is attached to the bottom portion of the negative pressure generation chamber 103, whereas the air vent 107 is in the top wall of the negative pressure generation chamber 103. Further, the negative pressure generation chamber 103 is filled with a porous member 108, and the ink outlet is filled with a porous member 109. In the case of this cartridge main assembly 101, the ink in the ink storage chamber 102 is supplied to the printer main assembly 201 through the ink outlet 106 after going through the negative pressure generation chamber 103.

Referring to FIGS. 1–3, the cartridge main assembly 101 has a projection 111, which is an integral part of the cartridge main assembly 101 and protrudes from the bottom front edge of the cartridge main assembly 101. The cartridge main assembly 101 also has a cartridge locking lever 112, which also is an integral part of the cartridge main assembly 101 and protrudes diagonally (up and backward) from the rear bottom edge of the cartridge main assembly 101. The cartridge locking lever 112 is elastically movable in the frontward or backward of the cartridge main assembly 101, and has a cartridge locking claw 113, which is on a predetermined portion of the rear surface of the cartridge locking lever 112.

Figure 4:
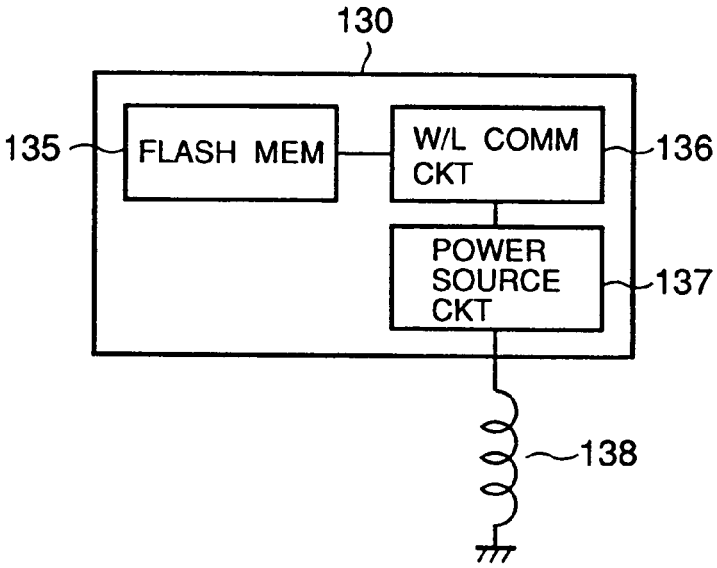
FIG. 4 is a block diagram showing the structure of the circuitry chip.

This embodiment of an ink cartridge 100 in accordance with the present invention has a circuitry chip 130, in the form of a piece of sheet, which is embedded in the rear portion of the bottom wall of the cartridge main assembly 101. Referring to FIG. 4, this circuitry chip 130 has a flash memory 135 as an information storage means, a wireless communication circuit 136 as both a wireless transmitting means and an information storing means, and a power source circuit 137 as a part of the power generating means.

The flash memory 135 stores in an updatable fashion, the cartridge identification information (unshown) regarding the cartridge type, types of the compatible printers, production date, expiration date, remaining amount of ink, etc.

Referring to FIG. 4, to the power source circuit 137, an induction coil 138 as a part of the power generating means is connected. This induction coil 138 constitutes, for example, the bottom layer of the circuitry chip 130. The combination of the induction coil 138 and power source circuit 137 generates electric power, based on electromagnetic induction. The generated electric power is supplied from the power source circuit 137 to the wireless communication circuit 136, which uses the electric power to transmits the predetermined type of information in the flash memory 135, in the form of radio waves, and also to receive radio waves, extract predetermined type of information carried by the received radio waves, and store the information in the slash memory 135.

Figure 6:
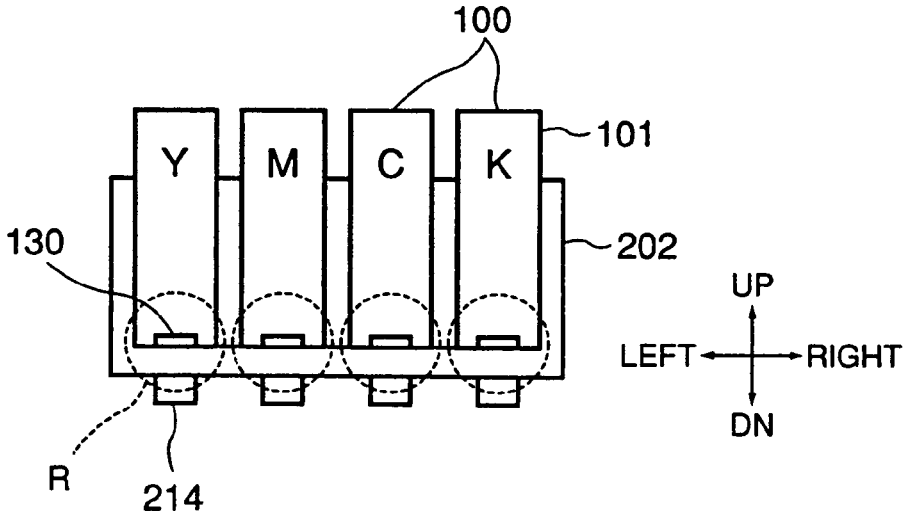
FIG. 6 is a front plan view of the carriage, as a cartridge holding means, holding a plurality of ink cartridges.

This ink cartridge 100, however, is not provided with an antenna (unshown) for extending the communication range R of the wireless communication circuit 136. Therefore, the communication range R (radius of the sphere in which radio waves from wireless transmitting means are receivable) of the wireless communication circuit 136 is limited to "0.3 (mm)", as shown in FIGS. 1 and 6. It should be noted here that the communication range R can be adjusted to an optimal value with the use of an antenna.

Referring to FIG. 6, the printing apparatus 200 is a full-color ink jet printer, and employs one carriage 202, and four ink cartridges 100. The carriage 202 functions as both a cartridge holding means and a communicating means holding means. The four ink cartridges 100 are different in the color of the ink therein (yellow, magenta, cyan, and black), and are arranged in the left-right direction, on the carriage 100.

Referring to FIG. 1, the carriage 202 is provided with a recess 203, which has a projection 204 and a locking claw 205. The projection 204 protrudes rearward from the bottom portion of the front surface of the recess 203. The locking claw 205 is for locking an ink container in the proper position, and projects frontward from a predetermined point on the rear surface of the recess 203. With the projection 204, which is on the front side of the carriage 202, the projection 111 of the ink cartridge 100 engages, whereas with the locking claw 205, the locking claw 113 of the ink cartridge 100 engages.

The carriage 202 is also provided with an ink inlet 206 as an ink receiving means, which is attached to the rear portion of the bottom wall of the recess 203, and to which the ink inlet 106 of the ink cartridge 100 is removably connectable. More specifically, in the case of this printing apparatus 200, a porous member, that is, a piece of porous substance (unshown), is also disposed in the ink inlet 206. Thus, as the ink cartridge 100 is properly mounted into the recess 203 of the carriage 202, the porous member 109 in the ink outlet 106 of the ink cartridge 100 comes into contact with, and is compressed by, the porous member in the ink inlet 206 of the carriage 202, creating a state in which the ink 104 can be supplied to the printer main assembly 201 from the ink cartridge 100.

Figure 5:
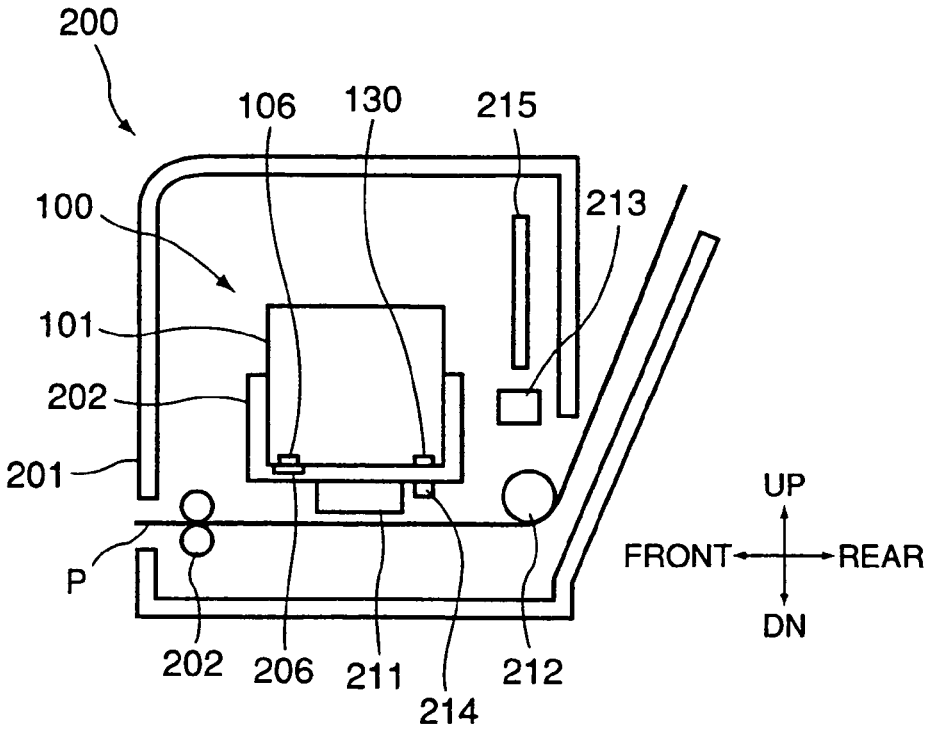
FIG. 5 is a schematic sectional view of a printing apparatus, showing the internal structure thereof.

Referring to FIG. 5, to the bottom surface of the carriage 202, an ink jet head 211 is attached. This combination of the carriage 202 and ink jet head 211 is supported by a primary scan mechanism (unshown) as a cartridge moving means so that the combination can be freely moved in the left-right direction. The primary scan mechanism comprises a single or plurality of guide rails, a driver motor, etc.

In the bottom portion of the internal space of the printer main assembly 201, there is disposed a secondary scan mechanism (unshown) comprising a feed roller 212, a driving motor 213, etc. A sheet of printing paper P is conveyed frontward so that it opposes the ink jet head 211 from underneath.

Next, referring to FIG. 6, four communication units 214, as both a power supplying means and a wireless communicating means, are attached to the rear portion of the bottom surface of the carriage 202, in alignment, one for one, with the four locations of the carriage 202, to which the four ink cartridges 100 different in the color of the ink therein are mounted.

Although not shown, not only does each of the four communication units 214 electromagnetically induce electric current in the corresponding induction coil 138 of the ink cartridge 100, but also it wirelessly exchanges predetermined types of information with the corresponding wireless communication circuit 136 of the ink cartridge 100.

However, the radius of the communication range R of the circuitry chip 130 of the ink cartridge 100 employed by this printing apparatus 200 in accordance with the present invention is "0.3 mm". Thus, each communication unit 214 is disposed so that when the ink cartridge 100 is in the proper position in the printing apparatus 200, the distance between the communication chip 214 and the corresponding circuitry chip 130 is "0.2 mm", for example.

Referring to FIG. 5, in the rear portion of the internal space of the printer main assembly 201, there is disposed a circuitry substrate 215, which is connected to the primary scan mechanism, secondary scan mechanism, ink Jet head 211, communication units 214, etc. The circuitry substrate 215 has a microcomputer (unshown), which integrally controls each of the above listed sections.

Figure 8:
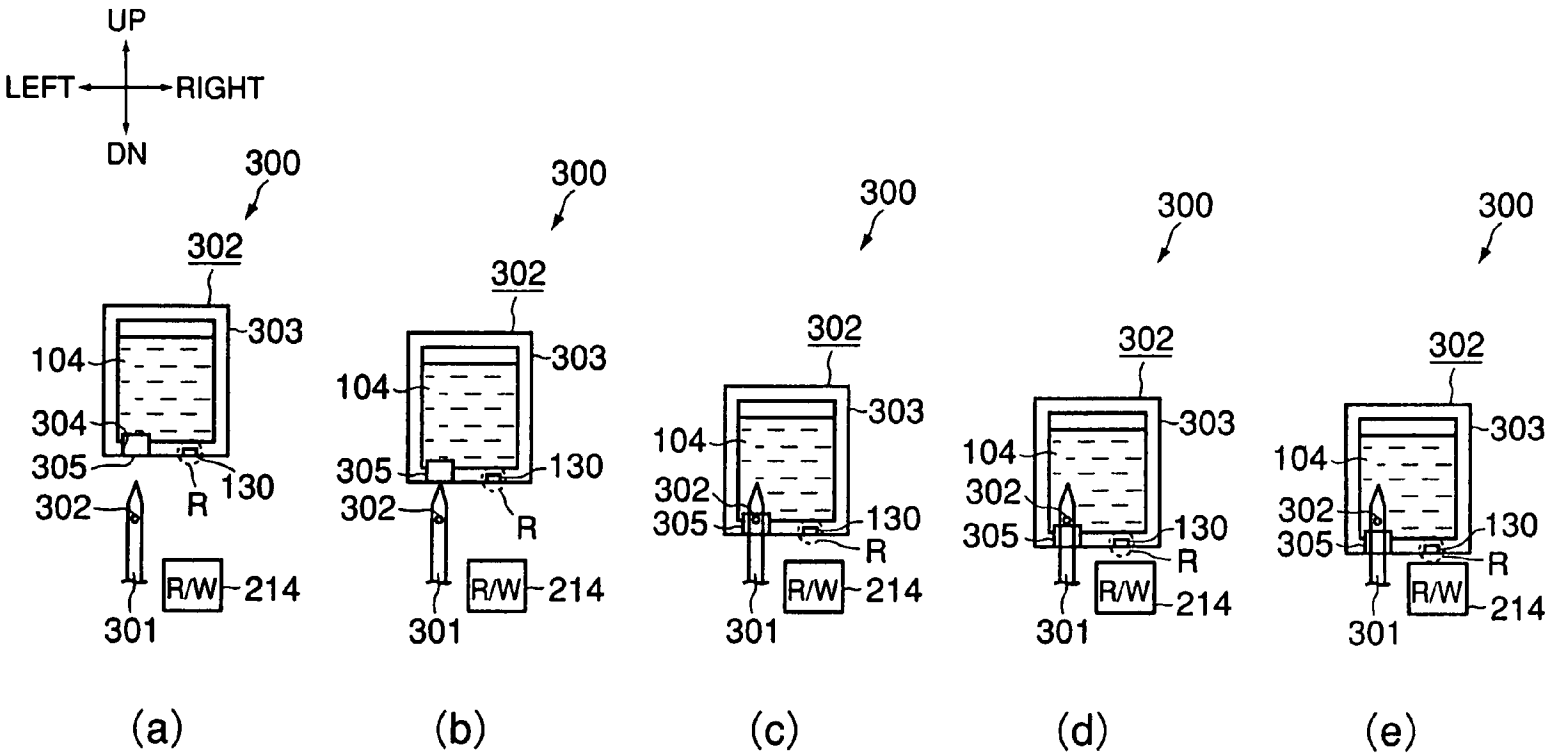
FIG. 8 is a schematic vertical sectional view of the ink container and its adjacencies, at a plane parallel to the front surface of the printing apparatus, during the mounting of the ink container into the main assembly of the printing apparatus, showing the steps followed during the mounting of the ink container into the main assembly of the printing apparatus.
Figure 9:
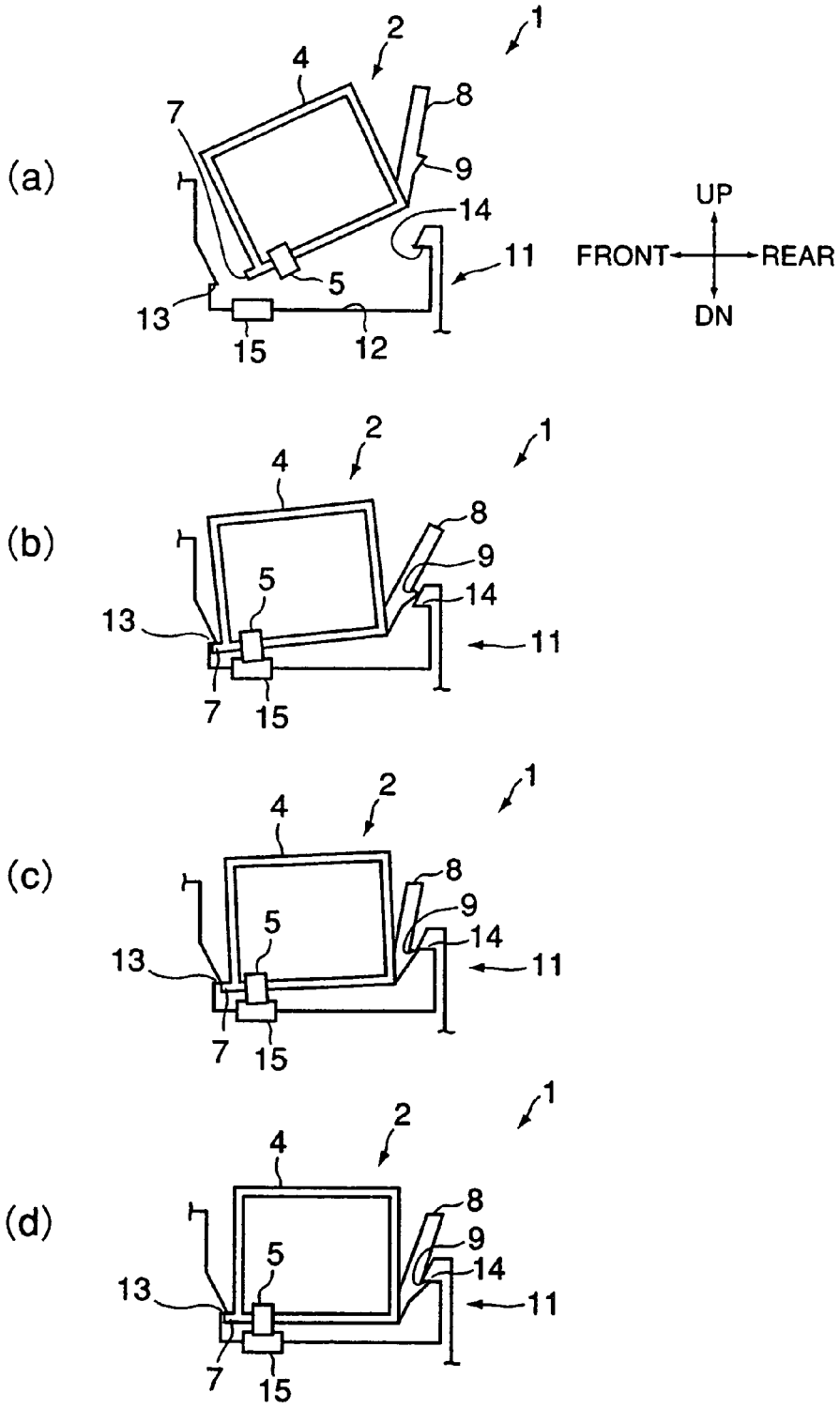
FIG. 9 PRIOR ART
FIG. 9 is a schematic vertical sectional of the combination of an ink container in accordance with the prior art, and a printing apparatus in accordance with the prior art, showing the steps followed during the mounting of the former into the latter.

Next, the usage of this ink cartridge 100 in accordance with the present invention, which is structured as described above, will be concretely described. In the final stage of ink cartridge production, various types of information, for example, data for identifying ink cartridge type, is stored in the circuitry chip 130 of each ink cartridge 100. The ink cartridge 100 is mounted into the printer main assembly 201 by an end user, in the following manner, as shown in FIGS. 1 and 8.

First, referring to FIG. 1(*a*), the ink cartridge 100 is to be held tilted so that the rear portion is higher than the front portion, as in the case of the printing apparatus 1 in accordance with the prior arts. Then, the ink cartridge 100 is to be mounted into the carriage 202 diagonally downward from the rear side so that the projection 111 of the ink cartridge 100 is engaged with the projection 204 of the carriage 202, as shown in FIG. 1(*b*).

Next, referring to FIG. 1(*c*), the rear portion of the ink cartridge 100 is to be pushed down, while elastically bending the locking lever 112 of the ink cartridge 100, in contact with the locking claw 205 of the carriage 202, until the locking claw 113 of the locking lever 112 engages with the locking claw 205 of the carriage 202, as shown in FIG. 1(*d*).

Referring to FIGS. 1(*a*)–1(*c*), in the case of this embodiment of the present invention, that is, the printing apparatus 200, however, the communication unit 214 of each ink cartridge 100 does not enter the communication range R of the corresponding circuitry chip 130 until the final stage of the proper mounting of the ink cartridge 100 into the carriage 202; the communication unit 214 of each ink cartridge 100 is in the communication range of the corresponding circuitry chip 130 only during and after the final stage of the proper and complete mounting of the ink cartridge 100 into the carriage 202.

In other words, only as the ink cartridge 100 is properly mounted into the carriage 202, it becomes possible for the printer main assembly 201 to wirelessly communicate with the ink cartridge 100; unless the ink cartridge 100 is properly mounted into the carriage 202, the printer main assembly 201 cannot communicate with the ink cartridge 100.

Figure 7:
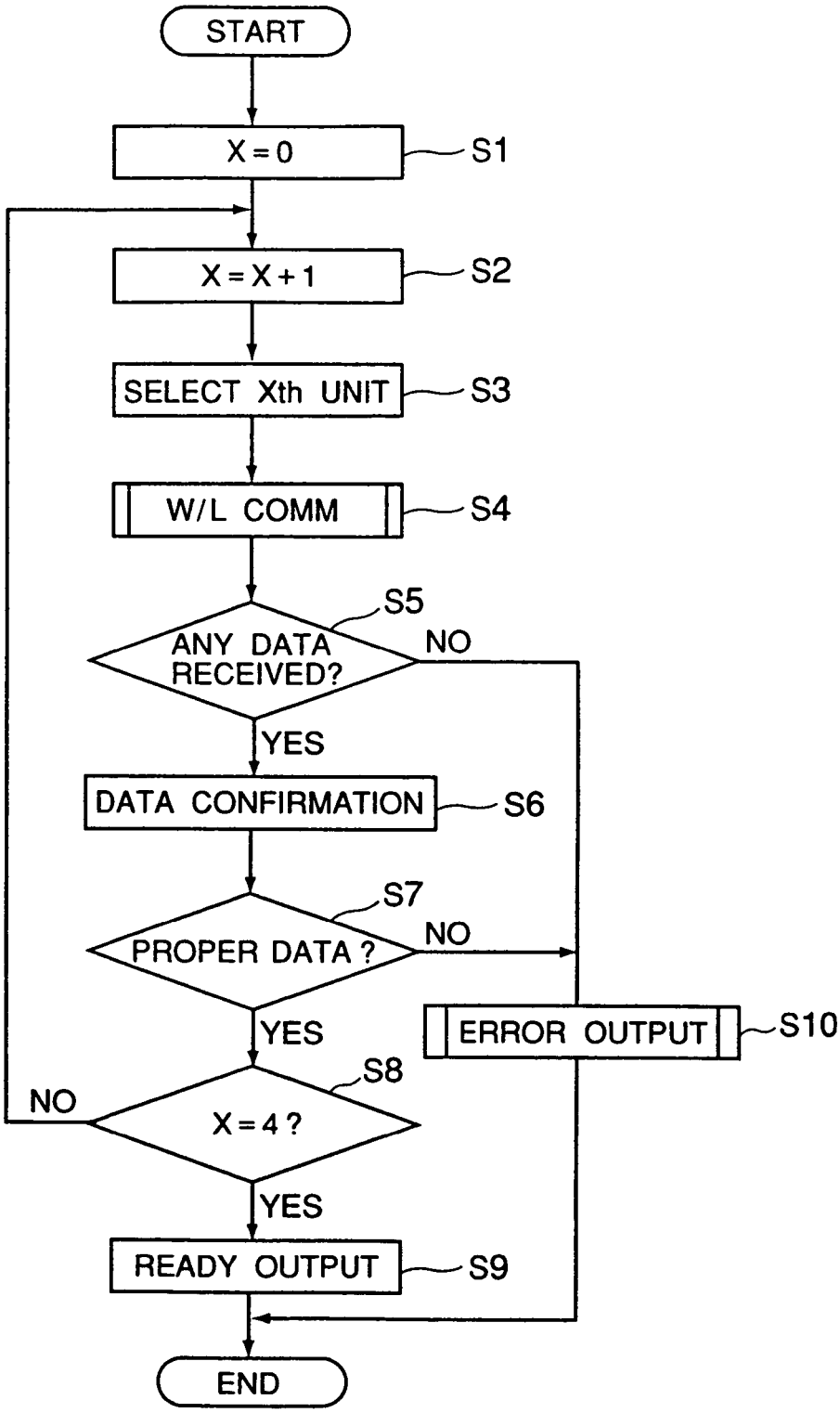
FIG. 7 is a flowchart showing the initialization process of the printing apparatus.

Referring to FIG. 7, as an end user, for example, mounts the four ink cartridges 100 into the printing apparatus 200 connected to a host computer (unshown), and turns on the printing apparatus 200, the four communication units 214 of the printing apparatus 200 begin sequentially and wirelessly communicating with the four ink cartridges 100, one for one (Steps S1–S4).

If a given communication unit 214 does not receive radio waves (Step S5), the printing apparatus 200 determines that there is no ink cartridge in the location corresponding to the given communication unit 214, and sends signals to the host computer, informing it of the ink cartridge mount error (Step S8).

As the given communication unit 214 receives radio waves from an ink cartridge 100 (Step S5), it is confirmed, based on the data carried by the received radio waves, whether or not the ink cartridge 100 on the specific location of the carriage 202, corresponding to the given communication unit 214, is proper in various aspects and properties, for example, the color of the ink therein, amount of the ink remaining therein, expiration date, etc. (Step S6). If a single or plurality of improprieties are detected in this step, error messages corresponding to the improprieties are sent to the host computer (Step S8).

On the other hand, if the printing apparatus 200 determines that the four ink cartridges 100 all have been properly mounted, it sends a ready signal indicating the completion of the preparatory process to the host computer (Step S10). Recognizing this signal, the host computer sends printing data to the printing apparatus 200, and the printing apparatus 200 begins to carry out a printing operation. Incidentally, each time a printing operation is completed, the printing apparatus 200 calculates the amount of the ink 104 consumed for the operation, and updates the information regarding the remaining amount the ink 104 in the ink cartridge 100.

In the case of this embodiment of the present invention, that is, the printing apparatus 200, the communication unit 214 of each ink cartridge 100 does not enter the communication range R of the corresponding circuitry chip 130 until the final stage of the proper mounting of the ink cartridge 100 into the carriage 202, as described above. In other words, the communication unit 214 of the printer main assembly is in the communication range of the corresponding circuitry chip 130 only during and after the final stage of the proper and complete mounting of the ink cartridge 100 into the carriage 202. Therefore, whether or not the ink cartridge 100 has been properly mounted can be confirmed through the wireless communication between the circuitry chip 130 and communication unit 214.

In addition, since the circuitry chip 130 and communication unit 214 wirelessly communicate with each other, with the use of radio waves, it is assured that even if the surface of the ink cartridge 100 and/or carriage 202 is contaminated with, or damaged by, the ink 104, it is always satisfactorily confirmed whether or not the ink cartridge 100 is in the proper position in the carriage 202.

Further, the carriage 202 of the printing apparatus 200 is enabled to hold four ink cartridges 100, and is provided with four communication units 214 disposed so that they will be within the communication ranges R of the four ink cartridges 100, one for one, only when the four ink cartridges 100 are in the proper locations in the carriage 202. Therefore, whether or not each of the four ink cartridges 100 is in the proper location in the carriage 202 can be confirmed, independently from the other ink cartridges 100.

Further, the radius of the communication range R of the wireless communication circuit 136 of this ink cartridge 100 in accordance with the present invention is limited to "0.3 mm" by not connecting it to a radio antenna. In other words, the communication range R is limited to a desired value with the use of the simple structural arrangement.

As described above, each ink cartridge 100 is limited in the communication range R. Therefore, even if four ink cartridges 100 are disposed on a single carriage 202, there is no interference among the communications between the four ink cartridges 100 and the corresponding communication units 214.

Moreover, not only can the above described wireless communication be used to confirm whether or not a given ink cartridge 100 is in the proper location of the carriage 202, but also it can be used for the various data communication between the printer main assembly 201 and the given ink cartridge 100. In other words, the above described structural arrangement for the combination of the ink cartridge 100 and apparatus main assembly 201 offers a plurality of functions in spite of its simplicity.

Even though the present invention was described above with reference to the embodiments of the present invention in the form of the combination of an ink cartridge and an ink jet printer, the application of the present invention is not limited to the above described embodiments. In other words, the present invention can be variously modified within the scope of its essence. That is, the present invention can be applied to various apparatuses, which employ a single or plurality of cartridges, and in the main assembly of which each cartridge must be properly mounted. For example, the present invention is applicable to: an electrophotographic printer, in the main assembly of which a single or plurality of toner cartridges are mounted; a video deck, in which a single or plurality of video cassettes are mounted; a camera in which a single or plurality of photographic film cartridges are mounted, a flexible disc drive in which a single or plurality of flexible disc-cartridges are mounted; and the like.

According to another aspect of this embodiment, the ink cartridge 100 is provided with the flash memory 135, in which the predetermined information is stored in the updatable fashion, making it possible for the printer main assembly 201 or the like to read the predetermined information from the flash memory 135 of the ink cartridge 100, and also to write information into the flash memory 135. However, it is possible to provide the ink cartridge 100 with a ROM (Read Only Memory), as an information storage medium, holding the predetermined information, so that the printer main assembly 201 and a wireless communicating apparatus 209 can read the predetermined information from the ROM of the ink cartridge 100.

Further, this embodiment demonstrates such a structural arrangement that the ink cartridge 100 is provided with a flash memory as an information storage medium. However, an EEPROM (Electrically Erasable Programmable ROM), a RAM (Random Access Memory) connected to a battery, a FeRAM (Ferro-electric RAM), a ROM, or the like, may be employed, instead of the flash memory, as the information storage medium of the ink cartridge etc.

Further, this embodiment demonstrates such a structural arrangement that the ink cartridge 100 is provided with the power generating means comprising the induction coil 138 and power source circuit 137, and electric power is generated by electromagnetic induction. However, it is possible to provide the ink cartridge 100 with a battery.

Further, this embodiment shows such a structural arrangement that as the porous member in the ink inlet 206 of the main assembly 201 of the printing apparatus 200 comes into contact with, and is pressed against, the porous member 109 in the ink outlet 106 of the ink cartridge 100, it becomes possible for the ink 104 to be supplied from the ink cartridge 100 to the printer main assembly 201. However, a structural arrangement other than this one may be employed.

Further, this embodiment provides various concrete numerical values. However, the numerical values given in this embodiment may be variously modified. For example, although the communication range R of the circuitry chip 130 in this embodiment is "0.3 mm", this value may be changed to the optimum value for determining whether or not the ink cartridge 100 is in the proper location in the printer main assembly 200.

[Embodiment 2]

Next, referring to FIG. 8, the second embodiment of the present invention will be described. The components, members, parts thereof, etc., of this embodiment, which are the same as those of the first embodiment, are given the same names and signs as those for the first embodiment, and their details will be not be described.

The main assembly (unshown) of this embodiment of a printing apparatus in accordance with the present invention, that is, a printing apparatus 300, is provided with a sharply pointed hollow needle-like member 301, as an ink receiving means. The needle-like member 302 has an opening 302, which is located a predetermine distance from the tip of the member 302, and which leads to the hollow (unshown) of the needle-like member 302.

There is not a porous member in the internal space main structure 303 of an ink cartridge 302; it is simply filled with ink 104. To the left portion of the bottom wall of the cartridge main structure 303, an ink outlet 304 as an ink supplying means is attached, and is hermetically sealed with a soft sealing member 305.

In the right portion of the bottom wall of the main structure 303 of the ink cartridge 302, there is embedded a circuitry chip 130, whereas in the printer main assembly, there is disposed a communication unit 214 on the right side of the needle-like member 301. Referring to FIG. 8(*e*), the communication unit 214 of this printing apparatus 300 is disposed so that only when the opening 302 of the needle-like member 301 of the printer main assembly is in the internal space of the cartridge main assembly 303 of the ink cartridge 302, the communication unit 214 will be within the communication range R of the circuitry chip 130.

Referring to FIGS. 8(*a*)–8(*d*), as the ink cartridge 302 structured as described above is mounted into the main assembly of the printing apparatus 300 structured as described above, the needle-like member 301 is pushed into the sealing member 305 of the ink cartridge 302. By the time the ink cartridge 302 is disposed in the proper position in the cartridge main assembly 303, the opening of the 302 of the needle-like member 301 reaches the predetermined position in the cartridge main assembly 303, making it ready for the ink 104 to be supplied from the ink cartridge 302 to the printer main assembly.

As described above, the communication unit 214 of this printing apparatus 300 will be within the communication range R of the circuitry chip 130 of the ink cartridge 302 only when the ink cartridge 302 is in the proper position in the printer main assembly. Therefore, whether or not the ink cartridge 302 has been properly mounted in the printer main assembly can be confirmed based on the initiation (or presence) of the radio communication between the circuitry chip 130 and communication unit 214.

More specifically, only after the opening 302 of the needle-like member 301 of the printer main assembly has moved a sufficient distance into the internal space of the main structure 303 of the ink cartridge 302, the communication unit 214 of this printing apparatus 300 will be within the communication range R of the circuitry chip 130 of the ink cartridge 302. Therefore, an end user is prompted to keep on pushing down the ink cartridge 302 until the ink cartridge 302 reaches the point at which the ink 104 is reliably supplied to the printer main assembly. Thus, even if there are small errors in the shapes of the printer main assembly and/or ink cartridge 302, or a small amount of play between the printer main assembly and ink cartridge 302, it is assured that the ink 104 is always satisfactorily supplied to the printer main assembly.

According to the present invention, unless an ink cartridge is properly mounted in the main assembly of a printer, radio communication is not established between the radio transmitting means of the ink cartridge and the radio communicating means of the printer main assembly. Therefore, it is possible to satisfactorily confirm whether or not the ink cartridge is in the proper position in the printer main assembly.

While the invention has been described with reference to the structures disclosed herein, it is not confined to the details set forth, and this application is intended to cover such modifications or changes as may come within the purposes of the improvements or the scope of the following claims.

What is claimed is:

1. An ink jet recording apparatus comprising:

an ink jet head; and an ink cartridge mounting portion for mounting an ink cartridge for containing ink to be supplied to said ink jet head, wherein said ink cartridge is detachably mountable to said ink jet head, and includes an information memory mediun, storing predetermined information, and wireless sending means which is capable of sending the predetermined information stored in said information memory medium within a predetermined limited range;

wherein said mounting portion of said recording device is provided with wireless communicating means for wirelessly receiving the information sent from said wireless sending means of said ink cartridge;

wherein said wireless communicating means is disposed in said predetermined limited range when said ink cartridge is mounted properly to said mounting portion, wherein said ink jet recording apparatus further comprises electric power supplying means for supplying electric power to said ink cartridge through electromagnetic induction, and said ink cartridge includes electric power generating means for generating electric power through the electromagnetic induction and supplying the electric power to said wireless sending means; and wherein said ink jet recording apparatus further comprises electric power control means for permitting supply of the electric powcr to said electric power supplying means at predetermined timing, and error discriminating means for discriminating mounting error upon failure of wireless reception of the information by said wireless communicating means when the electric power is supplied thereto.

2. An apparatus according to claim 1, wherein said wireless communicating means is positioned outside the predetermined limited range before said ink cartridge is mounted to said mounting portion, and is positioned inside the predetermined limited range after said ink cartridge is mounted to said mounting portion.

3. An apparatus according to claim 1, wherein said mounting portion is capable of mounting a plurality of such ink cartridges, and there are provided a plurality of such wireless communicating means which are capable of communication with respective ink cartridges.

* * * * *